US005993912A

United States Patent [19]

Yoo

[11] Patent Number: 5,993,912

[45] Date of Patent: Nov. 30, 1999

[54] METHOD FOR MANUFACTURING A CHARGING ROLLER

[75] Inventor: Ki Sung Yoo, Kyungki-do, Rep. of Korea

[73] Assignee: Dongsung Chemical Co., Ltd., Pusan, Rep. of Korea

[21] Appl. No.: 08/975,971

[22] Filed: Nov. 21, 1997

[30] Foreign Application Priority Data

Feb. 28, 1997 [KR] Rep. of Korea ..... 97-6606

[51] Int. Cl.[6] ..... B05D 1/36

[52] U.S. Cl. ..... 427/409; 492/53; 492/54; 29/895.32; 428/34.1; 428/35.8

[58] Field of Search ..... 492/53, 54; 29/895.32; 428/34.1, 35.8; 427/409

[56] References Cited

U.S. PATENT DOCUMENTS 3,959,574 5/1976 Seanor et al. ..... 428/425
5,126,913 6/1992 Araya et al. ..... 361/225
5,363,176 11/1994 Ishihara et al. ..... 355/219
5,386,279 1/1995 Fukami et al. ..... 355/271
5,541,001 7/1996 Vreeland et al. ..... 428/423.1
5,543,224 8/1996 Sakai et al. ..... 428/409
5,571,457 11/1996 Vreeland et al. ..... 252/519
5,602,712 2/1997 Daifuku et al. ..... 361/225
5,705,274 1/1998 Inoue et al. ..... 428/411.1
5,725,922 3/1998 Nakamura et al. ..... 428/36.9
5,742,880 4/1998 Takenaka et al. ..... 399/176
5,766,753 6/1998 Murata et al. ..... 428/323
5,776,544 7/1998 Naka et al. ..... 427/307
5,792,533 8/1998 Kurokawa et al. ..... 428/36.9

*Primary Examiner*—Diana Dudash
*Assistant Examiner*—Paul D. Strain
*Attorney, Agent, or Firm*—Finnegan, Henderson, Farabow, Garrett & Dunner L.L.P.

[57] ABSTRACT

This invention relates to a process for manufacturing a charging roller used in an image formation device according to the method of electrophotography; and more particularly, to a process for forming the surface layer with uniform resistivity on the surface of the charging roller coated with certain soluble conductive agent, thus ensuring better charging effects.

5 Claims, 8 Drawing Sheets

METHOD FOR MANUFACTURING A CHARGING ROLLER

FIELD OF THE INVENTION

This invention relates to a process for manufacturing a charging roller used in an image formation device according to the method of electrophotography; and more specifically, a process for forming the surface layer with uniform resistivity on the surface of the charging roller coated with certain soluble conductive agent, thus ensuring better charging effects.

BACKGROUND OF THE INVENTION

In general, some image formation devices according to the method of electrophotography (e.g., electronic copier, laser beam printer, facsimile, etc.) are operated in such a manner that electrostatic latent images are formed on the surface of a photoconductor drum; images are developed on the drum by a toner; such developed images are transferred and fixed on a record paper to give a picture.

Hence, a method of forming the electrostatic latent images comprises in that after charging the whole surface of a photoconductor drum, the image of manuscript or a laser beam by the electric signal in a computer is exposed on the drum, and lost electric charge exposed by light results in obtaining the electrostatic latent images in the shape of manuscript or electric signal.

Meantime, the common methods of charging the surface of a photoconductor drum are being carried out by corona and contact methods but recently, there has been a trend toward the contact charging method as more preferable than corona, since the latter has encountered safety problems and excessive generation of ozone due to higher voltage (4~8 KV) of direct current used.

As illustrated in the attached FIG. 2 and FIG. 3, in such contact charging method a photoconductor drum (10), contacted with a charging roller (1), is rotated and then, a voltage between them is applied, thereby charging the surface of photoconductive layer (14) on the drum. The contact charging method is superior to the corona charging method in that no generation of ozone is observed since the former adopts a lower voltage (0.5~2 KV) than the latter.

Also, the above contact charging method uses an elastomer roller having good conductivity designed for better charging performance and active electric contact between the photoconductor drum (10) and charging roller (1).

However, if the conductivity of a charging roller is excessively large and electric resistance is too low, excessive current flow may inflict damage on the photoconductor drum or mechanical equipment. In case of defects such as pin hole on the surface of the photoconductor drum or damages of the fragment, excessive current is leaked out through the defective areas and the whole surface of the photoconductor drum contacted at that moment cannot be evenly charged. As a result, a black line will occur.

To overcome such occurrence of black line, the U.S. Pat. No. 5,126,913 disclosed a method of restricting the intensity of current by forming a high resistance layer at the surface of a conductive elastomer roller.

Nevertheless, if the surface resistance of a charging roller becomes too high, the intensity of current flowing at the surface becomes lowered and a lot of currents do not flow into some defected area, even if some defects such as pin hole exist at the surface of the photoconductor. Thus, the removal of black line may be available but when the surface of the photoconductor drum is charged, poor charging efficiency may cause a charging insufficiency.

In general, the resistivity of surface layer should be in the range of $10^7$~$10^9$ Ω·cm so as to allow the appropriate conductivity to the surface layer but it has been reported that a very difficult technical problem exists in providing a roller surface layer with accurate resistivity, since such resistivity is in the scope of semi-conductivity.

The method of manufacturing the conventional charging roller comprises in that a common form of conductive powder (carbon black, graphite, metal powder, etc.) is dispersed in a binder (resin solution, etc.) to give a conductive paint, which functions to coat the surface of a conductive roller.

As for the conductive film, so formed, small numbers of conductive particles are mixed in the resin; in an accurate term, there are two different parts—extremely high resistance (resin) and extremely low resistance (conductive particles) and the distribution of conductive particles is thought not to be uniform at all surfaces.

In other words, the conventional conductive paint comprises in that a conductive powder is mixed with a binder such as resin and in case of the electric resistance at some areas where the conductive powder is crowded or dispersed in the resin, it is extremely higher or lower than standard value. In this respect, two local parts exist such as extremely high resistance and extremely low resistance.

If electric resistance of the surface layer using such conductive paint becomes extremely large charging insufficiency occurs. Further, when a part with extremely high resistance is contacted with the defective area of the photoconductor, black lines appear in the image recorded due to excessive current.

Therefore, it is very difficult to form an uniform surface layer having constant resistance values at the surface of a roller.

SUMMARY OF THE INVENTION

It is therefore an object of the invention to provide a process for manufacturing a charging roller designed to achieve excellent charging effects by forming the conductive surface layer with an uniform resistivity on the surface of a charging roller used in an image formation device of electrophotography method, using certain soluble conductive agents.

To fulfill the above object, this invention is characterized in that a soluble conductive paint is provided by dissolving 0.5~5.0% of soluble conductive agent and 5.0~15.0% of binder resin to 80.0~94.5% of certain solvent and extremely high or low resistance part does not exist, while the surface layer has an uniform resistivity.

EXPLANATION OF MAIN CODES AS DEFINED IN THE DRAWING

| | |
|---|---|
| 1: Charging roller | 3: Shaft |
| 5: Conductive elastomer layer | 7: Surface layer |
| 10: Photoconductor drum | 12: Al substrate |
| 14: Photoconductive layer | 20,30: Power supply |

DETAILED DESCRIPTION OF PREFERRED EMBODIMENTS

This invention may be understood and its object and advantages will become apparent to those who are familiar with the art. One example of this invention is explained in more detail in the accompanying drawings.

One example of the materials and methods employed in the example of this invention is intended for explanation and the scope of this invention is not limited by such example.

Figure 2:
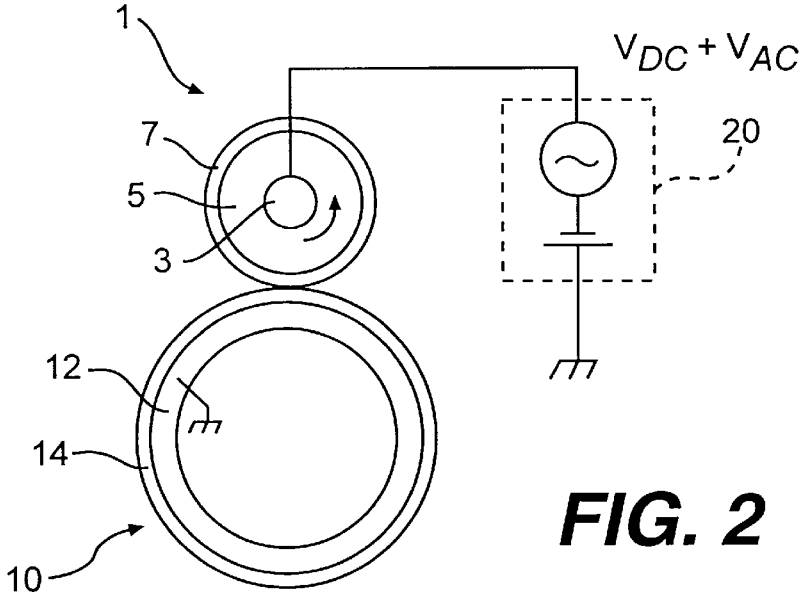
FIG. 2 and FIG. 3, showing some applied examples of a charging roller according to this invention, are schematic views illustrating the method of using an alternating current, a complex power supply of direct current including a direct current power supply.
Figure 3:
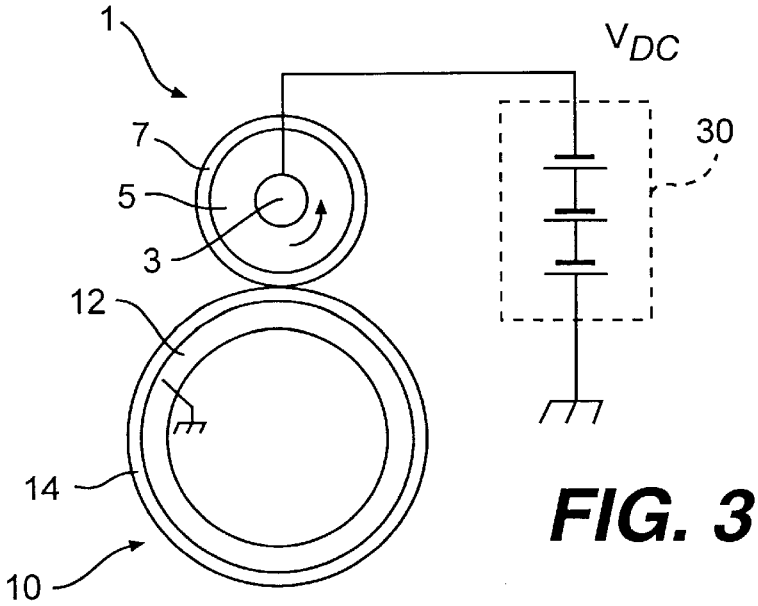

Referring to FIG. 2, this invention is characterized in a method of manufacturing plural layer types of a charging roller comprising a metal shaft (3) in the centre and a conductive elastomer layer (5) in its outer circumference; and then a surface layer (7) with uniform thickness is formed at the surface of the conductive elastomer layer (5).

The preferred example of this invention is characterized in that the surface layer (7) comprises a soluble conductive paint whose thickness is 20~50 $\mu$m.

Further, the soluble conductive paint is characterized by comprising 0.5~5.0% of a soluble conductive agent, 5.0~15.0% of a binder resin, and 80.0~94.5% of a solvent to dissolve the soluble conductive agent and binder resin.

Also, the soluble conductive agent is characterized by selecting one or more compounds from the following groups: polyethylene glycol, polyethylene oxide, ferrous dicyclopentadienyl, dicyclopentadienyl chrome, dicyclopentadienyl nickel, dicyclopentadienyl cobalt, azo compounds containing chrome or cobalt, tetracyanoquinodimethane compounds, phenylene compounds, tetracyanoethylene compound and phenylenediamine compound.

Also, the resistivity of the surface layer (7) is $10^5$~$10^9$ Ωcm.

This invention is explained in more detail by referring to the accompanying drawings.

Figure 1:
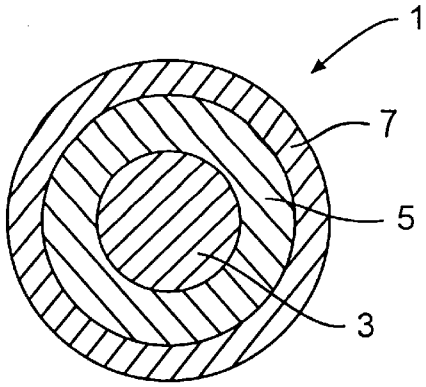
FIG. 1 is a cross sectional view showing a sectional structure of a charging roller according to this invention.

FIG. 1 shows a sectional structure of a charging roller according to this invention.

Hence, the drawing code 1 denotes the whole charging roller and the drawing code 3 denotes a metal shaft.

According to this invention, the surface of the metal shaft (3) is coated with a conductive elastomer layer (5) to fabricate a conductive elastomer roller; and on the top of it, a soluble conductive paint is again used to coat a surface layer (7) with uniform thickness, thus having an uniform resistance value and enhancing the charging effects.

Hence, this invention consists of the following processes:

a) a process of preparing a conductive elastomer roller, b) a process of preparing a soluble conductive paint, and c) a coating process to form an uniform conductive surface layer (7) at the surface of the conductive elastomer layer. From the aforementioned processes, two processes to manufacture the conductive elastomer roller and to coat the conductive surface layer are carried out by a well-known method, and each process is explained by referring to the following example.

EXAMPLE

1) Preparation of Conductive Elastomer Roller

The conductive elastomer roller is fabricated by a well-known method.

One example is carried out in that;

(1)—a stainless steel or iron material was cut by 251 mm in length and 6 mm in outer diameter;

(2)—the cutting material was plated with nickel or chrome in a thickness of 2~5 $\mu$m to prepare a shaft (3) of the conductive elastomer roller;

(3)—a conductive elastomer layer (5) was formed at the surface of shaft to prepare a conductive elastomer roller.

Hence, the conductive elastomer layer (5) was prepared in such a manner that a conductive powder was dispersed for mixing in an elastomer material with the resistivity of $10^5$~$10^9$ Ω·cm and hardness (HsA) of 40~50°, respectively; and then, the surface of a conductive elastomer roller, so prepared, was polished so as to have a rubber with an outer diameter containing the shaft (3) of 11.8 mm and its length of 231 mm.

In particular, the elastomer material can include acrylonitrile-butadiene rubber (NBR), epichlorohydrine, silicon, ethylene-propylene diene (EPDM), or polyurethane (PU), while the conductive powders can include conductive carbon black, graphite powder, copper powder, or nickel powder.

2) Preparation of Surface Layer-forming Paint

The paint was obtained by mixing 2.41% of a soluble conductive agent, 10.33% of a binder resin and 87.26% of a solvent to dissolve the soluble conductive agent and binder resin. The following table 1 shows one example of a surface layer-forming paint according to this invention.

TABLE 1

| Component | Weight (g) |
|---|---|
| Polyurethane resin (solid 18%) | 100 |
| Soluble conductive agent | 4.2 |
| Methyl ethyl ketone | 70 |
| Others (coloring agent, etc.) | (idea quantity) |
| Total | 174.2 |

The surface layer-forming paint with the above composition was prepared in such a manner that;

As shown in the above table 1, 50 g of methyl ethyl ketone was added to 250 ml beaker and with the addition of a soluble conductive agent (a mixing composition of hydrophilic macromolecules and metal compound) in small amounts; the mixture was completely dissolved by slow rotation of an agitator, so installed.

Then, polyurethane resin (manufactured by Dongsung Chemical Co., U.S.-908; solid 18%) was added to this solution and filtered. Then, 20 g of methyl ethyl ketone was poured into a beaker and stirred for 30 minutes continuously to prepare a soluble conductive paint.

Hence, the polyurethane resin and methyl ethyl ketone function as a binder resin and solvent, respectively.

3) Formation of Surface Layer

The surface of a conductive elastomer roller was uniformly coated with the soluble conductive paint, so prepared according to the above 2) method, by some well-known methods such as spray, precipitation or roll-coating. After being dried, the fragment was homogeneously coated so as to have the thickness of 20~50 $\mu$m and the uniform surface layer (7) was formed. Thus, a charging roller of this invention, so manufactured, was named as No. 1.

Comparative examples 1 and 2 were described as set forth below for comparing the example of this invention with the following comparative examples.

Comparative Example 1

1) Preparation of Conductive Elastomer Roller

As described in the same procedure of the example 1), a conductive elastomer roller was prepared.

2) Preparation of Surface Layer-forming Paint

TABLE 2

| Component | Weight (g) |
|---|---|
| Polyurethane resin (Solid 18%) | 100 |
| Conductive carbon black | 0.6 |
| Methyl ethyl ketone | 70 |
| Dispersing agent | 0.5 |
| Total | 171.1 |

As the table 2, 50 g of polyurethane resin was added to 50 g of methyl ethyl ketone and followed by the addition of 0.6 g of conductive carbon black (KETJEN BLACK EC), the solution was well mixed.

After being left for 24 hrs, 0.5 g of dispersing agent (BYK 130) was added to the resulting solution and dispersed at 20,000 r.p.m. for about 20 minutes using a high-speed disperser.

Continuously, 50 g of polyurethane resin was also added to the mixture, re-stirred for well-mixing and at the same time, filtered. The filtrate and 20 g of methyl ethyl ketone were poured into a washed beaker and re-stirred for about 30 minutes to prepare a dispersion-type conductive paint.

3) Formation of Surface Layer

As in the same procedure of the example as above 3), the dispersion-type conductive paint, was used for coating a conductive elastomer roller so as to form a dispersion-type conductive layer, being named as a charging roller No. 2.

Comparative Example 2

1) Preparation of Conductive Elastomer Roller

As described in the procedures of example and comparative example 1, a conductive elastomer roller was prepared.

2) Preparation of Surface Layer-forming Paint

TABLE 3

| Component | Weight (g) |
|---|---|
| Polyurethane resin (Solid 18%) | 100 |
| Methyl ethyl ketone | 70 |
| Total | 170 |

As shown in the above table 3, a mixture of polyurethane resin and methyl ethyl ketone was diluted to prepare a high-resistance type paint.

3) Formation of Surface Layer

As described in the same procedures of the example and comparative example 1, the high-resistance type paint, so prepared as the above method, was used for coating a conductive elastomer roller so as to form the high-resistance type conductive layer, being named as a charging roller No. 3.

As mentioned above, the electric resistances of each charging roller, so prepared, were measured and after installing them to a laser beam printer (manufactured by Hewlett Packard Co., laser Jet No. 4), the following print tests were performed, as shown in the table 4.

TABLE 4

Figure 4:
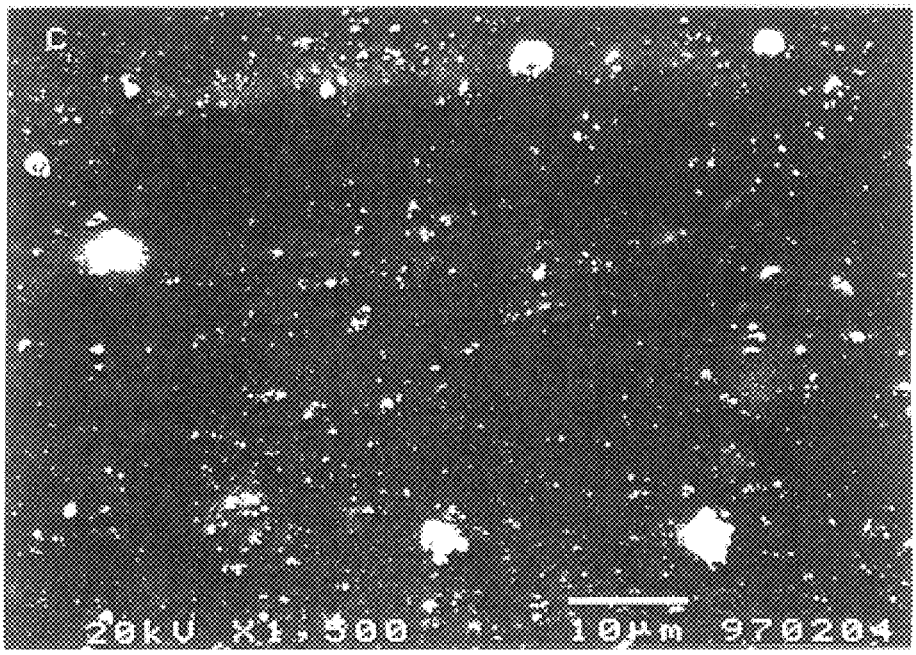
FIG. 4 and FIG. 5 are microscopic photographs showing a dispersed conductive fragment and uniform conductive fragment.
Figure 5:
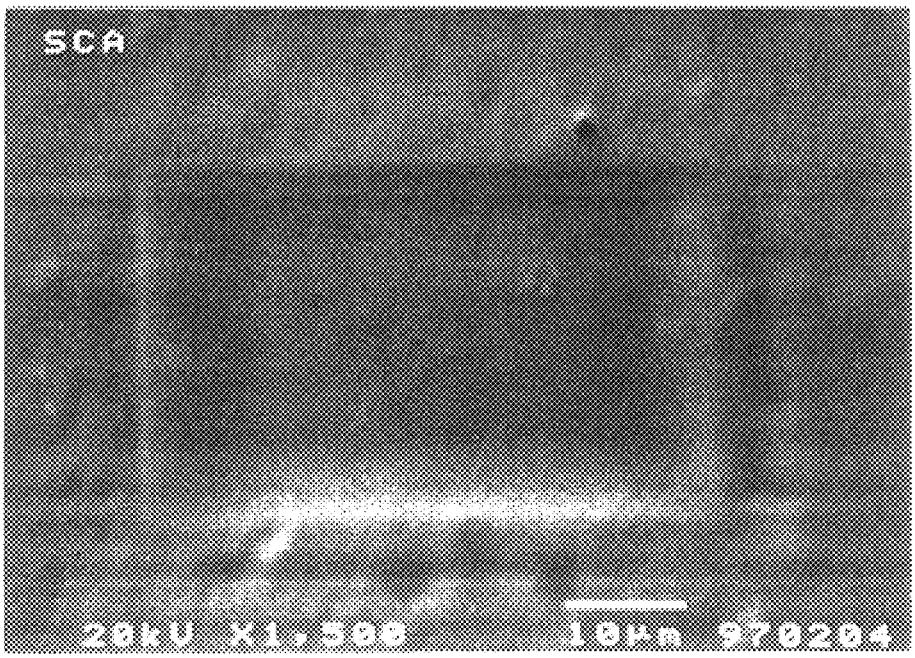

| Category | Example (Roller No. 1) | Comparative example 1 (Roller No. 2) | Comparative example 2 (Roller No. 3) | Remarks |
|---|---|---|---|---|
| Electric resistance (Ω) | $3.2 \times 10^9$ | $2.0 \times 10^{10}$ | $1.6 \times 10^{11}$ | |
| Printed results | | | | |
| Good drum | Good | Good | Contaminated | — |
| Defected drum | Good | Occurrence of black line | Contaminated | Detached part at surface fragment |
| Fragment | Uniform | Ununiform | Uniform | Microscopic photographs in FIG. 4 and FIG. 5 |

*Electric resistance was measured for the resistance between the surface of roller and metal shaft (SIMCO JAPAN INC. MODEL ST-3).

Figure 6:
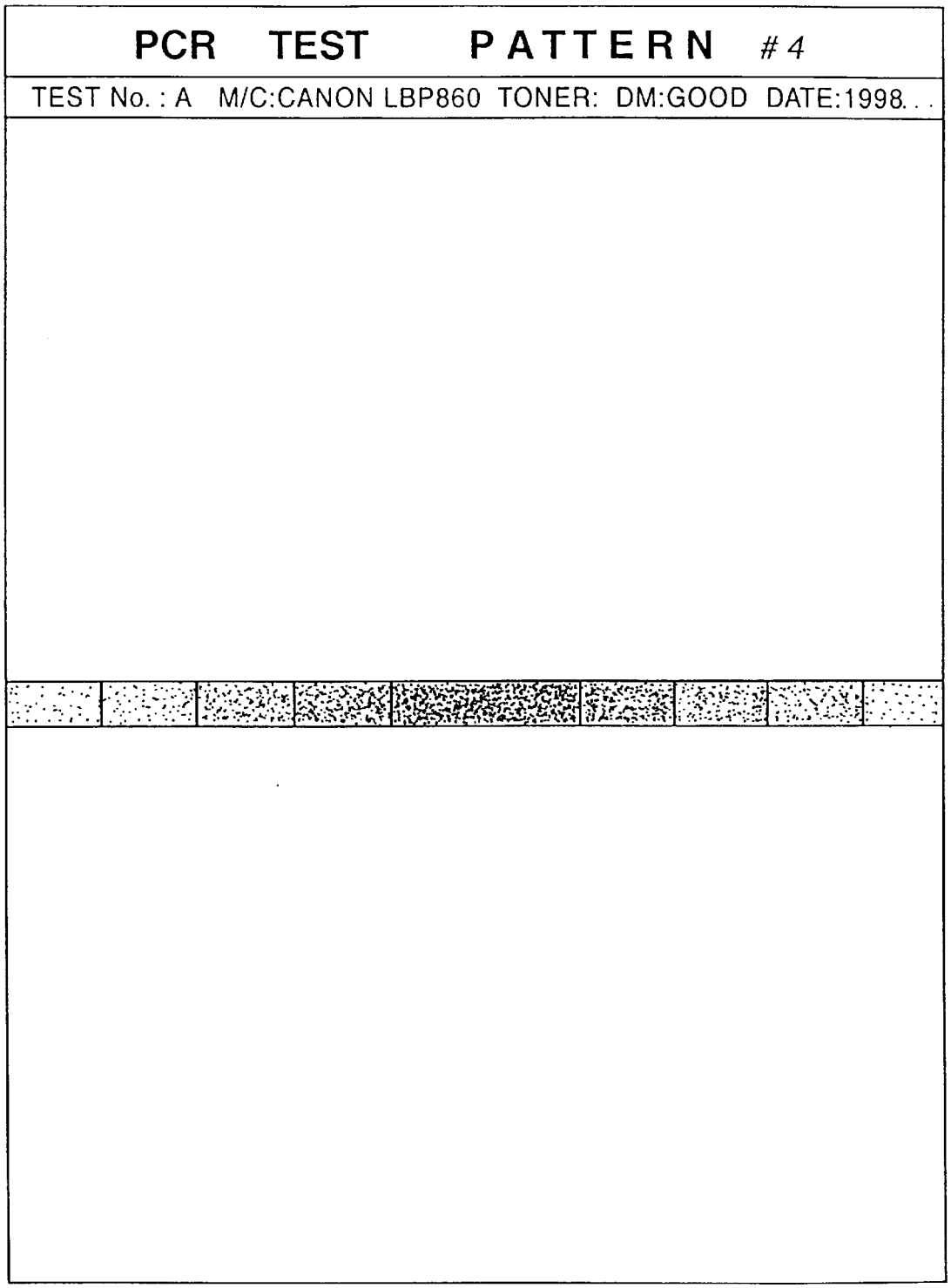
FIG. 6 to FIG. 11 are test samples showing the results of printing test based on the example of this invention and comparative examples 1 & 2.
Figure 7:
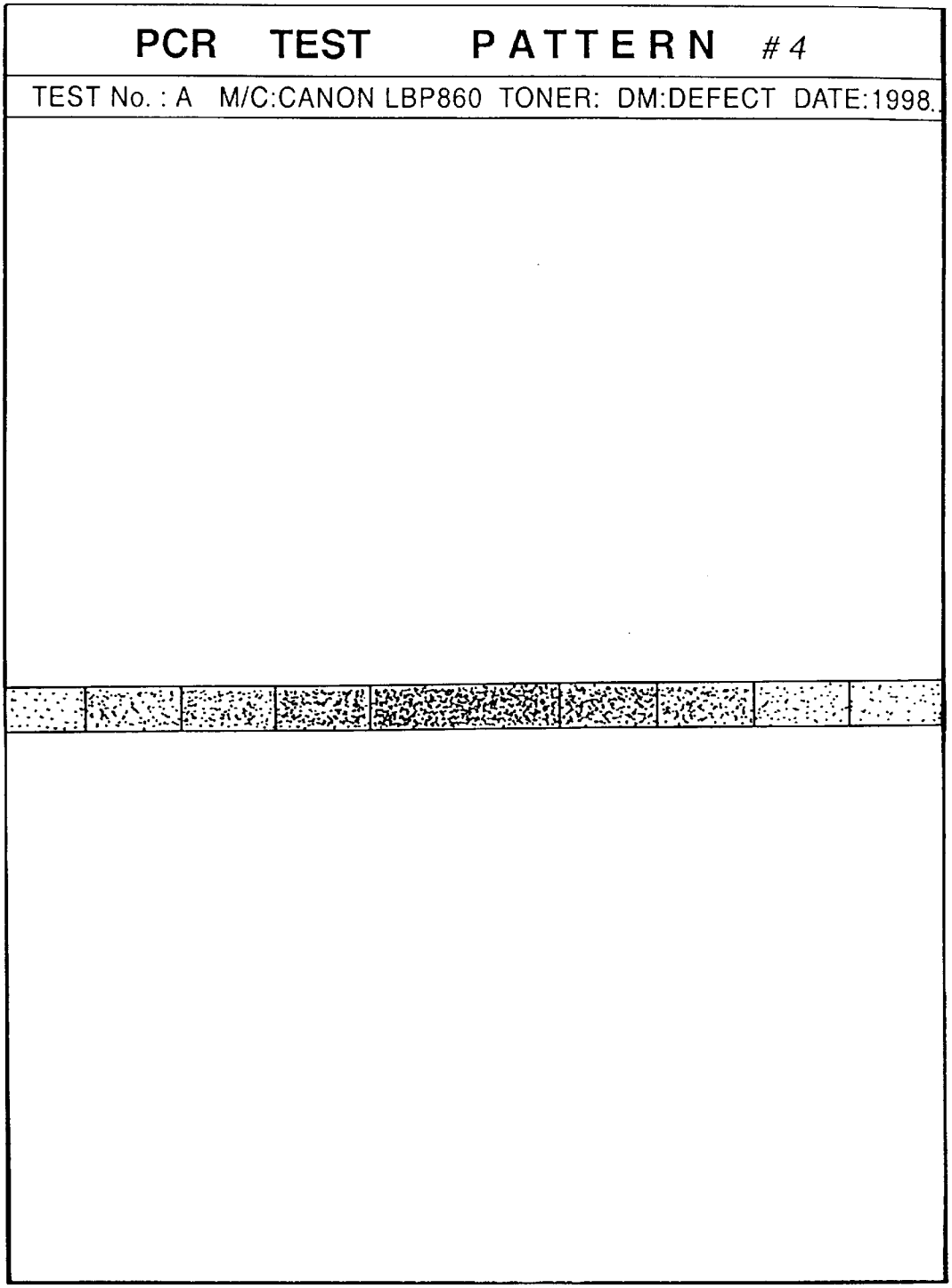

Based on these results, a charging roller, prepared from the example of this invention, has the following advantages in that;

a) extremely low resistance part does not exist because a uniform conductive surface layer coated with a soluble conductive agent at the surface of the roller is formed, b) excessive current is not leaked out from the defective drum (drum having some detached fragments at its surface), and c) better charging efficiency may be obtained based on appropriate conductivity (FIG. 6 and FIG. 7).

However, according to comparative example 1, the charging roller (No. 2) forming a dispersed conductive layer at its surface shows the dispersed state of particles of conductive carbon and two localized areas having extremely low resistance and extremely high resistance, respectively.

Figure 8:
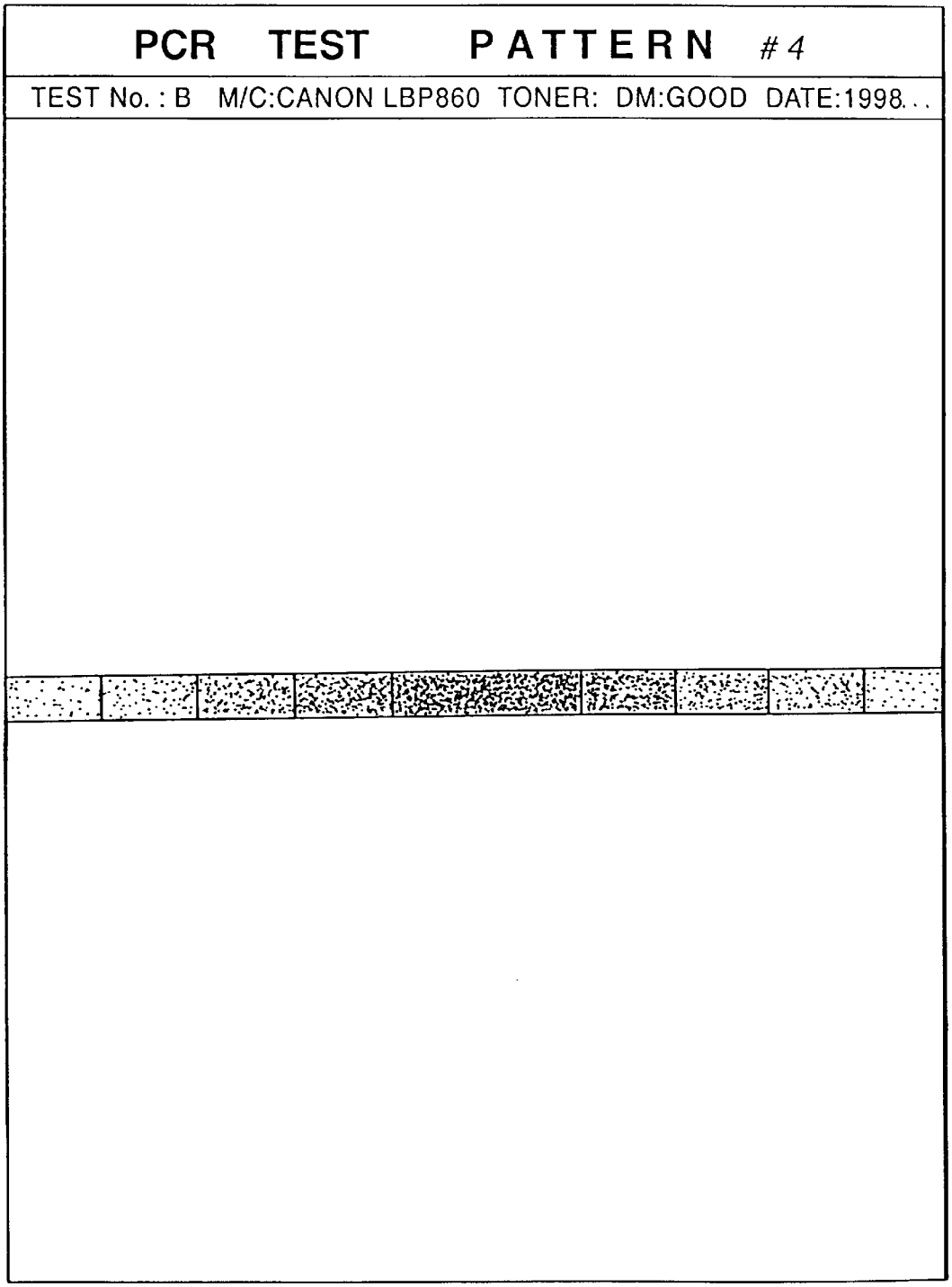
Figure 9:
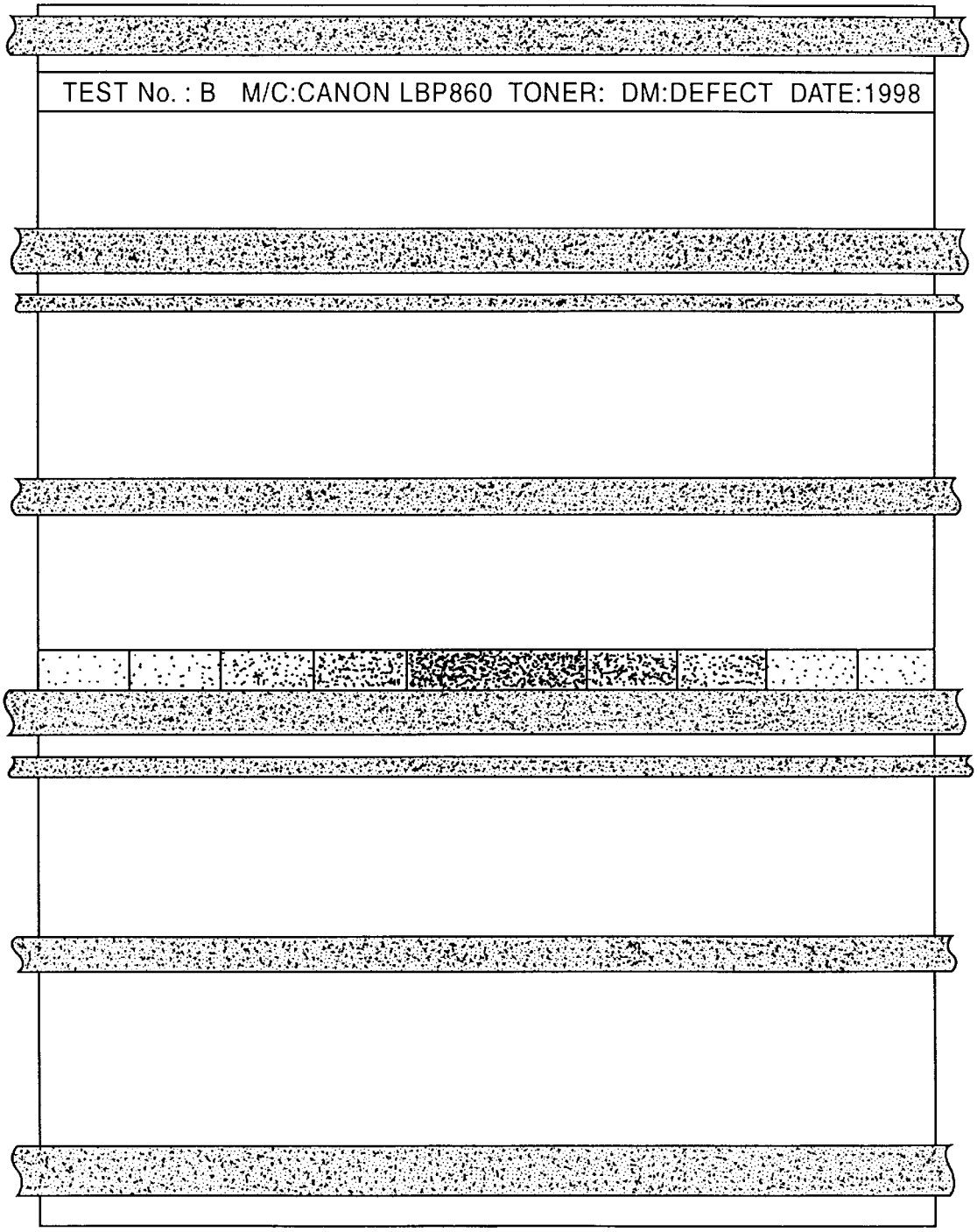

Therefore, when some defective area of a photoconductor drum (area where surface layer fragment is detached) exists, excessive current is leaked out from an extremely low resistance part and the charging at the defected area become insufficient. It is well noted that black lines appear at that area, when printed (FIG. 8 and FIG. 9).

Figure 10:
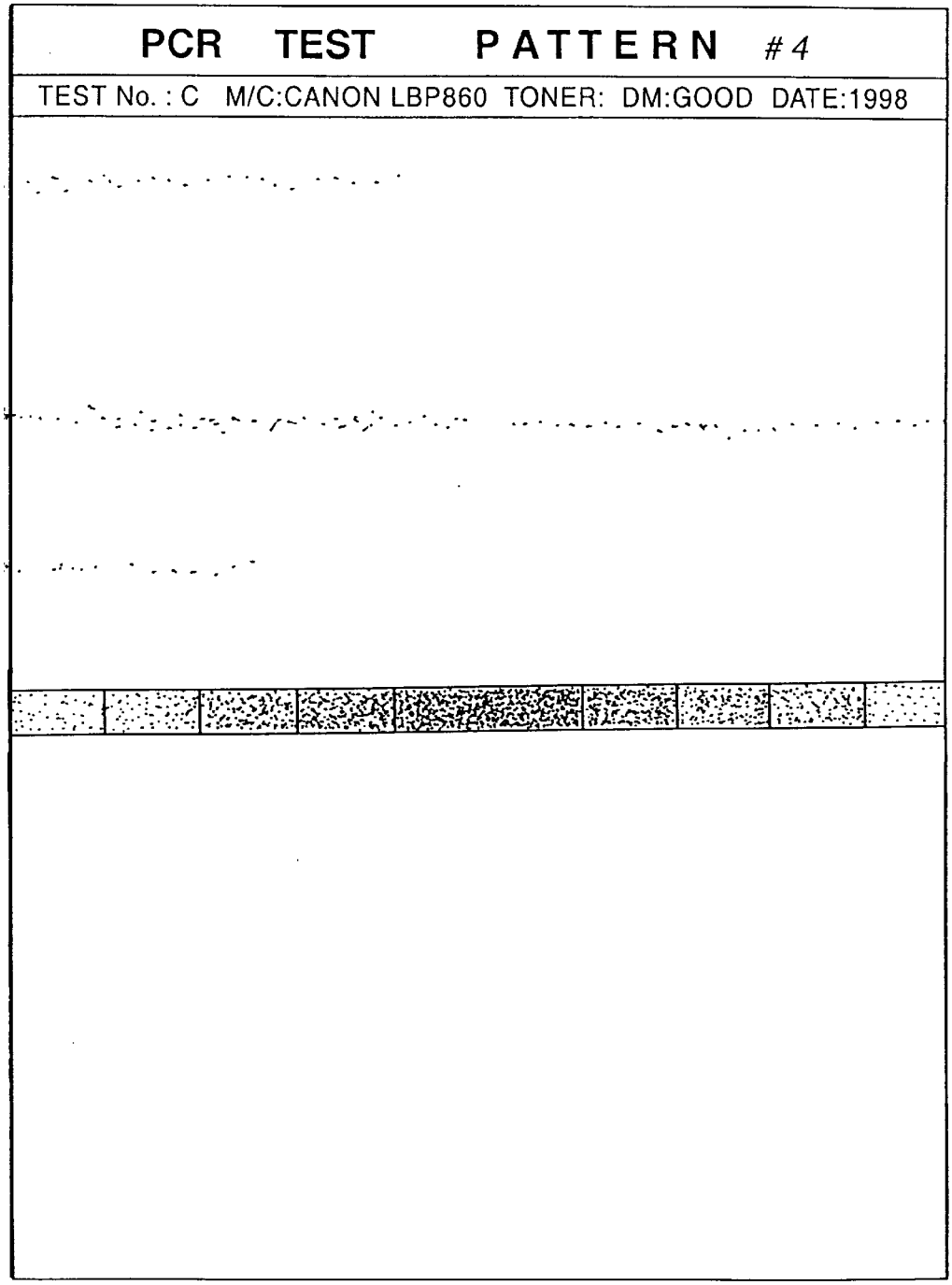
Figure 11:
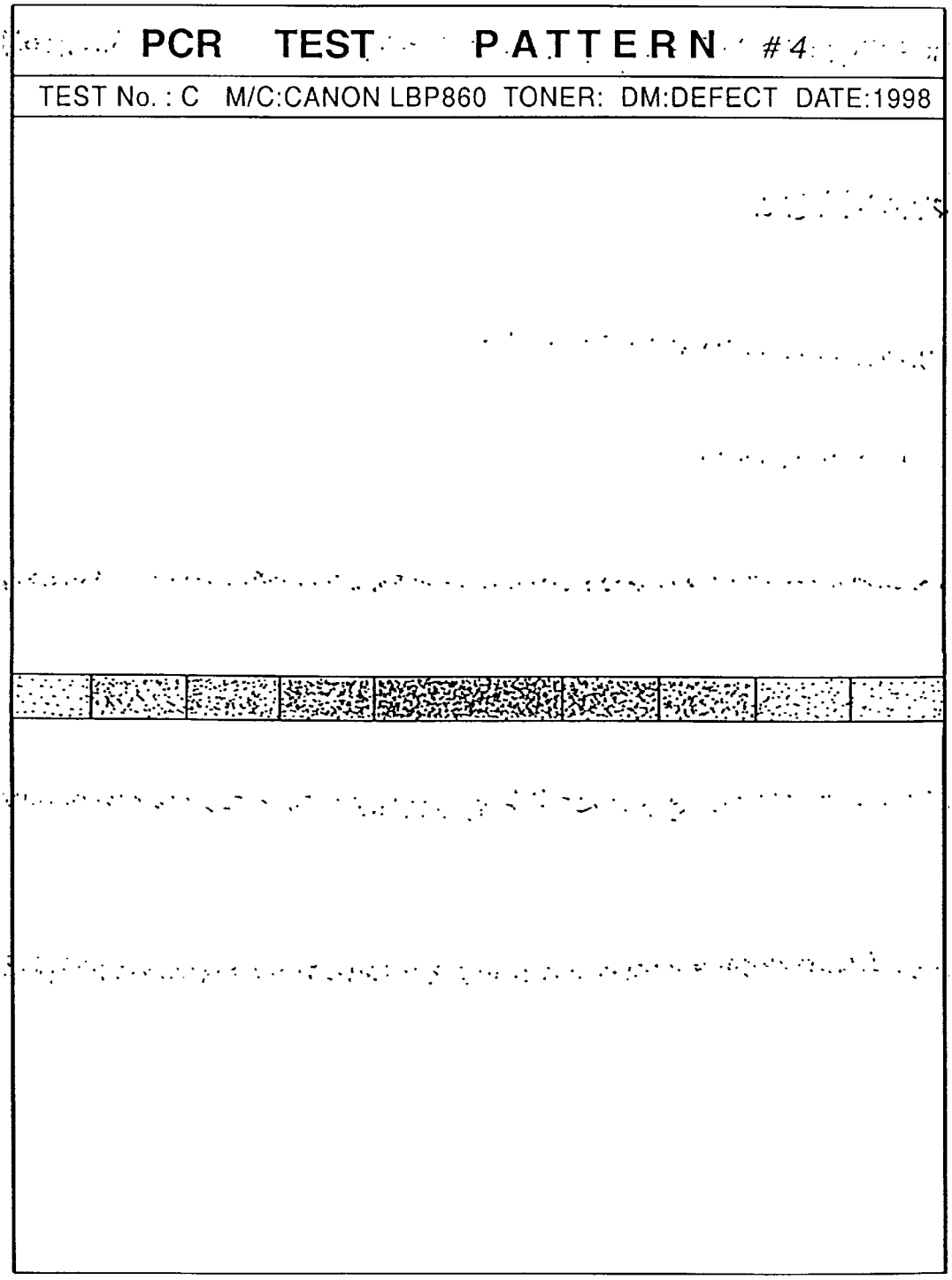

Further, according to comparative example 2, the charging roller (No 3) forming a high resistance layer on its surface shows whole charging insufficiency due to reduced charging efficiency induced by high resistance. Since there is less current leaked from the defective area of a drum as a matter of course, black lines do not occur when printed but the contamination appears at the base of images (FIG. 10 and FIG. 11).

As mentioned above, the process of manufacturing a charging roller according to this invention has advantages in that;

a) since the surface layer has uniform resistance value at the surface of a charging roller, excessive current is not leaked out at the damaged area of a photoconductor drum, and b) better charging efficiency may be obtained based on appropriate conductivity.

What is claimed is:

1. In a process for manufacturing a charging roller having a central metal shaft and a conductive elastomer layer on the outer circumference of the shaft, the improvement comprising the steps of:

preparing a soluble conductive paint comprising approximately 0.5%~5.0% of a soluble conductive agent, approximately 5.0%~15.0% of a binder resin, and approximately 80.0%~94.5% of a solvent for the conductive agent and binder resin, wherein the soluble conductive agent is completely dissolved in the solvent; and applying the soluble conductive paint to the surface of the conductive elastomer layer to form a surface layer of generally uniform thickness.

2. The process for manufacturing a charging roller according to claim 1, wherein the soluble conductive agent is selected from the group consisting of polyethylene glycol compounds, polyethylene oxide compounds, ferrous dicyclopentadienyl compounds, dicyclopentadienyl chrome compounds, dicyclopentadienyl nickel compounds, dicyclopentadienyl cobalt compounds, azo compounds containing chrome or cobalt, tetracyanoquinodimethane compounds, phenylene compounds, tetracyanoethylene compounds, or a mixture thereof.

3. The process for manufacturing a charging roller according to claim 1, wherein dried fragments of the soluble conductive paint have uniform conductive property.

4. The process for manufacturing a charging roller according to claim 1, wherein the resistivity of the surface layer (7) is $10^5$~$10^9$ Ωcm.

5. The process of claim 1 wherein the surface layer has a thickness of approximately 20~50 μm.

* * * * *